US009983500B2

(12) United States Patent
Yano et al.

(10) Patent No.: US 9,983,500 B2
(45) Date of Patent: May 29, 2018

(54) OPTICAL WRITING DEVICE AND IMAGE FORMING DEVICE

(71) Applicant: Konica Minolta, Inc., Chiyoda-ku, Tokyo (JP)

(72) Inventors: So Yano, Ibaraki (JP); Yasushi Nagasaka, Okazaki (JP); Masayuki Iijima, Okazaki (JP); Takahiro Matsuo, Toyokawa (JP); Takaki Uemura, Seto (JP); Akira Taniyama, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 78 days.

(21) Appl. No.: 15/080,769

(22) Filed: Mar. 25, 2016

(65) Prior Publication Data

US 2016/0282751 A1 Sep. 29, 2016

(30) Foreign Application Priority Data

Mar. 26, 2015 (JP) ..... 2015-064297

(51) Int. Cl.
*G03G 15/04* (2006.01)
*G03G 15/043* (2006.01)

(52) U.S. Cl.
CPC ..... *G03G 15/043* (2013.01); *G03G 15/04054* (2013.01); *G03G 2215/0132* (2013.01)

(58) Field of Classification Search
CPC ..... G03G 15/043; G03G 15/04054; G03G 2215/0132; H04N 1/4015; H04N 1/40006
See application file for complete search history.

(56) References Cited

U.S. PATENT DOCUMENTS 7,485,886 B2 * 2/2009 Nakajima ..... H04N 1/4015 250/553
2007/0040775 A1 2/2007 Horisaki et al.
(Continued)

FOREIGN PATENT DOCUMENTS

JP 2003-029710 A 1/2003
JP 2005-329634 A 12/2005
(Continued)

OTHER PUBLICATIONS

Notification of Reasons for Refusal issued in corresponding Japanese Patent Application No. 2015-064297, dated Mar. 14, 2017, with English Translation (7 pages).

*Primary Examiner* — Julian Huffman
*Assistant Examiner* — Michael Konczal
(74) *Attorney, Agent, or Firm* — Buchanan Ingersoll & Rooney PC

(57) ABSTRACT

An optical writing device performing optical writing with a light-emitting element, performing light amount switching, and including: a unit estimating a first value corresponding to a current amount for causing the element to emit a first light amount immediately after the switching; a unit supplying to the element, from immediately after the switching, a current amount corresponding to a first digital value acquired by quantizing the first value; a unit estimating a time amount through which a current amount for keeping the element emitting the first light amount increases from the current amount for causing the element to emit the first light amount immediately after the switching to a current amount corresponding to a second digital value greater than the first digital value by one step; and a unit supplying to the element, when the time amount elapses after the switching, the current amount corresponding to the second digital value.

14 Claims, 13 Drawing Sheets

(56) References Cited

U.S. PATENT DOCUMENTS

| | | | | |
|---|---|---|---|---|
| 2009/0122129 | A1 | 5/2009 | Tsujino et al. | |
| 2015/0317951 | A1* | 11/2015 | Genoe ..... | G09G 3/3283<br>345/212 |

FOREIGN PATENT DOCUMENTS

| | | | |
|---|---|---|---|
| JP | 2007-062020 | A | 3/2007 |
| JP | 2007-122001 | | 5/2007 |
| JP | 2010-076223 | A | 4/2010 |

* cited by examiner

FIG. 7A

Threshold value

| | | Surrounding temperature range | | | | |
|---|---|---|---|---|---|---|
| | | A | B | C | D | E |
| Preset light amount | 100W/m2 | TH(100A) | TH(100B) | TH(100C) | TH(100D) | TH(100E) |
| | 200W/m2 | TH(200A) | TH(200B) | TH(200C) | TH(200D) | TH(200E) |
| | 300W/m2 | TH(300A) | TH(300B) | TH(300C) | TH(300D) | TH(300E) |
| | 400W/m2 | TH(400A) | TH(400B) | TH(400C) | TH(400D) | TH(400E) |
| | 500W/m2 | TH(500A) | TH(500B) | TH(500C) | TH(500D) | TH(500E) |
| | 600W/m2 | TH(600A) | TH(600B) | TH(600C) | TH(600D) | TH(600E) |

FIG. 7B

Current increase amount per light emission

| | | Surrounding temperature range | | | | |
|---|---|---|---|---|---|---|
| | | A | B | C | D | E |
| Preset light amount | 100W/m2 | α(100A) | α(100B) | α(100C) | α(100D) | α(100E) |
| | 200W/m2 | α(200A) | α(200B) | α(200C) | α(200D) | α(200E) |
| | 300W/m2 | α(300A) | α(300B) | α(300C) | α(300D) | α(300E) |
| | 400W/m2 | α(400A) | α(400B) | α(400C) | α(400D) | α(400E) |
| | 500W/m2 | α(500A) | α(500B) | α(500C) | α(500D) | α(500E) |
| | 600W/m2 | α(600A) | α(600B) | α(600C) | α(600D) | α(600E) |

FIG. 7C

Current correction factor

| | | Surrounding temperature range | | | | |
|---|---|---|---|---|---|---|
| | | A | B | C | D | E |
| Preset light amount | 100W/m2 | γ(100A) | γ(100B) | γ(100C) | γ(100D) | γ(100E) |
| | 200W/m2 | γ(200A) | γ(200B) | γ(200C) | γ(200D) | γ(200E) |
| | 300W/m2 | γ(300A) | γ(300B) | γ(300C) | γ(300D) | γ(300E) |
| | 400W/m2 | γ(400A) | γ(400B) | 1 | γ(400D) | γ(400E) |
| | 500W/m2 | γ(500A) | γ(500B) | γ(500C) | γ(500D) | γ(500E) |
| | 600W/m2 | γ(600A) | γ(600B) | γ(600C) | γ(600D) | γ(600E) |

Influence of surrounding temperature

Influence of light amount

OPTICAL WRITING DEVICE AND IMAGE FORMING DEVICE

This application is based on an application No. 2015-064297 filed in Japan, the contents of which are hereby incorporated by reference.

BACKGROUND OF THE INVENTION (1) Field of the Invention

The present invention relates to an optical writing device and an image forming device, and in particular to a technology for preventing deterioration of image quality caused by switching a light emission amount of a light-emitting element used in an optical writing device from one preset light amount to another.

(2) Description of the Related Art

Recently, as a line-type optical writing device that can be provided with low cost, a print head with a light-emitting unit including organic light-emitting diodes (hereinafter referred to as "OLEDs") is proposed (such a print head is hereinafter referred to as an "OLED-PH"). OLEDs are known to have a characteristic such that the longer a total duration during which an OLED has emitted light (hereinafter simply referred to as a "light emission duration" of an OLED) becomes, the smaller the light amount emitted from the OLED when supplied with the same amount of driving current becomes. This decrease in light emission efficiency results in different pixels of an optical writing device emitting different light amounts. When this difference in light amount between pixels becomes as great as several percents, image unevenness in the form of stripes becomes no longer ignorable in printed images, and satisfactory image quality can no longer be achieved. Further, deterioration of an OLED over time progresses at a faster rate when the OLED is caused to emit a great light amount, and also, the rate of deterioration of an OLED over time changes depending upon the temperature around the OLED.

In view of this, for example, Japanese Patent Application Publication No. 2003-029710 discloses a technology for correcting a driving current amount supplied to each of a plurality of OLEDs by monitoring the light emission duration and the surrounding temperature of each OLED, and thereby ensuring that each OLED continues to emit a desired preset light amount. In addition, for example, Japanese Patent Application Publication No. 2005-329634 discloses a technology of monitoring a light emission duration of an OLED and boosting the driving voltage applied to the OLED when the light emission duration exceeds a predetermined duration. These conventional technologies enable suppressing the difference between light amounts of OLEDs occurring due to the deterioration of the OLEDS over time by correcting the amount of driving current supplied to the respective OLEDs. Thus, these conventional technologies prevent deterioration of image quality.

Typically, the amount of driving current supplied to an OLED is digitally controlled by using a digital to analog converter (DAC), and is increased step-by-step as the OLED deteriorate over time. For example, by increasing the amount of driving current supplied to an OLED by one least significant bit (LSB) each time the OLED has emitted light for a predetermined amount of time, it can be ensured that the amount of driving current actually supplied to the OLED (hereinafter referred to as an "actual current amount") equals the amount of driving current required for causing the OLED to emit a desired light amount (hereinafter referred to as a "target current amount"). However, during a time period from when the actual current amount is increased as described above until when the actual current amount is to be increased next, the actual current amount stays the same while the target current amount gradually increases. Due to this, during this time period, there is a difference between the actual current amount and the target current amount.

Further, in a typical image forming device, for example, the speed at which recording sheets are conveyed may be switched between full speed and half speed, depending upon whether the recording sheets being used are those with regular thickness or those with greater thickness. When switching from one sheet conveyance speed to another, a rotation speed of the photoreceptor drum of the image forming device is changed. Further, it is also necessary to change the amount of light emitted by an OLED included in an optical writing device of the image forming device, or that is, the amount of driving current supplied to the OLED, in order to ensure that the amount of light emission of the OLED remains the same before and after the switching of sheet conveyance speed.

However, as described above, there may be a difference between an actual current amount and an expected current amount of an OLED. That is, at the point when switching the sheet conveyance speed from full speed to half speed, the actual current amount before the switching may differ from the target current amount before the switching. When such a difference is present, even when the actual current amount after the switching is calculated by accurately halving the actual current amount before the switching, the difference between the actual current amount and the target current amount may remain present after the switching.

Meanwhile, because driving current supplied to an OLED is digitally controlled, it is not always possible to accurately halve the actual current amount before the switching to calculate the actual current amount after the switching. Accordingly, even when the actual current amount and the target current amount are equal before the switching of conveyance speed, the actual current amount and the target current amount may differ after the switching.

Further, such difference between the actual current amount and the target current amount of an OLED may also be produced when the light emission amount of the OLED is changed for purposes other than the switching of sheet conveyance speed.

SUMMARY OF THE INVENTION

The present invention has been achieved in view of the above problems, and an aim thereof is to provide an optical writing device and an image forming device that suppress a difference in driving current amount caused by switching a light emission amount of an OLED from one preset light amount to another, when compensating for a decrease in light emission efficiency of the OLED brought about by deterioration of the OLED over time.

In order to solve the above problems, one aspect of the present invention is an optical writing device performing optical writing by using a light-emitting element and capable of performing switching of a light amount of the light-emitting element between a plurality of preset light amounts, light emission efficiency of the light-emitting element decreasing as light-emission time increases, a driving current amount required for keeping the light-emitting element emitting one light amount increasing as light-emission time increases, the optical writing device including: a first target current value estimation unit estimating a first target current value corresponding to a driving current amount required for causing the light-emitting element to emit a first light amount immediately after the switching, the first light amount being one of the preset light amounts that is utilized after the switching; a first light emission control unit supplying to the light-emitting element, from immediately after the switching, a driving current amount corresponding to a first digital value acquired by quantizing the first target current value, and causing the light-emitting element to emit light; a time amount estimation unit estimating a time amount through which a driving current amount required for keeping the light-emitting element emitting the first light amount increases from the driving current amount required for causing the light-emitting element to emit the first light amount immediately after the switching to a driving current amount corresponding to a second digital value greater than the first digital value by one step; and a second light emission control unit supplying to the light-emitting element, when the time amount elapses after the switching, the driving current amount corresponding to the second digital value, and causing the light-emitting element to emit light.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIGS. 7A-7C illustrate examples of look-up tables (LUTs) stored in a driving current correction unit 600 of the ASIC 410, with FIG. 7A illustrating an LUT storing threshold values TH for a dot counter 611, FIG. 7B illustrating an LUT storing current increase amounts a for one light emission, and FIG. 7C illustrating an LUT storing current correction factors γ;

DESCRIPTION OF EMBODIMENTS

The following describes embodiments of an optical writing device and an image forming device pertaining to the present invention, with reference to the drawings.

[1] CONFIGURATION OF IMAGE FORMING DEVICE

Figure 1:
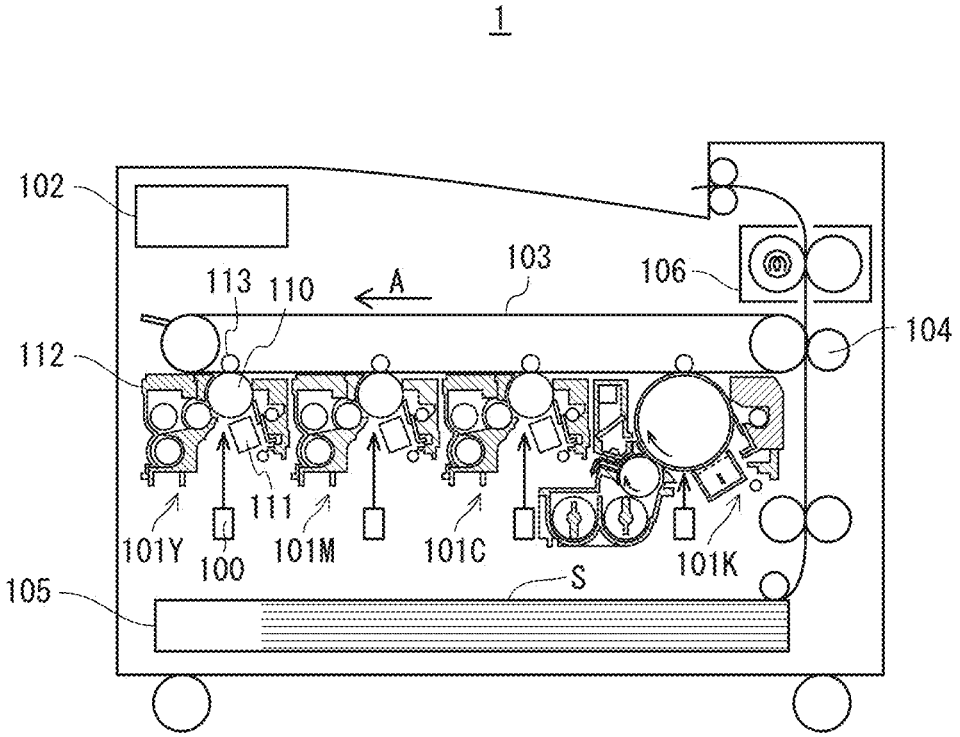
FIG. 1 illustrates a main configuration of an image forming device pertaining to an embodiment of the present invention.

FIG. 1 illustrates a main configuration of an image forming device 1 pertaining to the present embodiment. As illustrated in FIG. 1, the image forming device 1 is a color printer of a so-called tandem type. The image forming device 1 includes image forming units 101Y, 101M, 101C, and 101K. Each of the image forming units 101Y, 101M, 101C, and 101K forms, by being controlled by a control unit 102, a toner image of a corresponding one of the colors yellow (Y), magenta (M), cyan (C), and black (K).

For example, in the image forming unit 101Y, a charging device 111 uniformly charges an outer circumferential surface of a photoreceptor drum 110. An optical writing device 100 includes, as described in the following, a plurality of light-emitting elements (OLEDs) linearly arranged along a main scanning direction. The optical writing device 100 causes the OLEDs to emit light in accordance with digital luminance signals that the control unit 102 generates. Because of this, optical writing is executed onto the outer circumferential surface of the photoreceptor drum 110 and an electrostatic latent image is formed.

A developing device 112 supplies the outer circumferential surface of the photoreceptor drum 110 with toner and develops the electrostatic latent image to form a toner image. A primary transfer roller 113 electrostatically transfers the toner image from the photoreceptor drum 110 onto an intermediate transfer belt 103 (primary transfer).

In this manner, toner images of the colors Y, M, C, K, respectively formed by the image forming units 101Y, 101M, 101C, 101K, are primarily transferred onto the intermediate transfer belt 103 so as to overlap with each other and form a color toner image. When the color toner image arrives at a pair of secondary transfer rollers 104 due to being conveyed by the intermediate transfer belt 103, a recording sheet S that a paper feed cassette 105 supplies is conveyed to the pair of the secondary transfer rollers 104.

The pair of the secondary transfer rollers 104 electrostatically transfers the toner image on the intermediate transfer belt 103 onto the recording sheet S (secondary transfer). A fixing device 106 then fuses and fixes the toner image onto the recording sheet S. Then, the recording sheet S is ejected to an outside of the image forming device 1.

[2] CONFIGURATION OF OPTICAL WRITING DEVICE 100

The following describes a configuration of the optical writing device 100.

Figure 2:
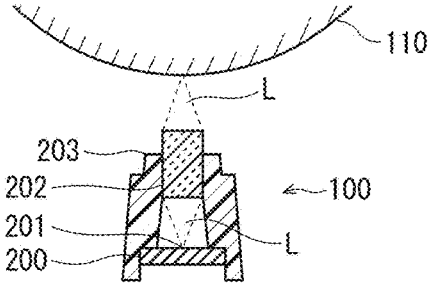
FIG. 2 is a cross-sectional view describing an optical writing operation by an optical writing device 100.

As illustrated in FIG. 2, the optical writing device 100 includes an OLED panel 200 and a SELFOC lens array (SLA; SELFOC is a registered trademark of Nippon Sheet Glass Co. LTD.) 202 that are accommodated in a holder 203. The OLED panel 200 includes OLEDs 201. Light beams B that the OLEDs 201 emit are collected onto the outer circumferential surface of the photoreceptor drum 110 by the SELFOC lens array 202. Meanwhile, the SLA may be replaced by a microlens array (MLA). Cables etc. required for connection with the image forming device 1 are omitted in FIG. 2.

Figure 3:
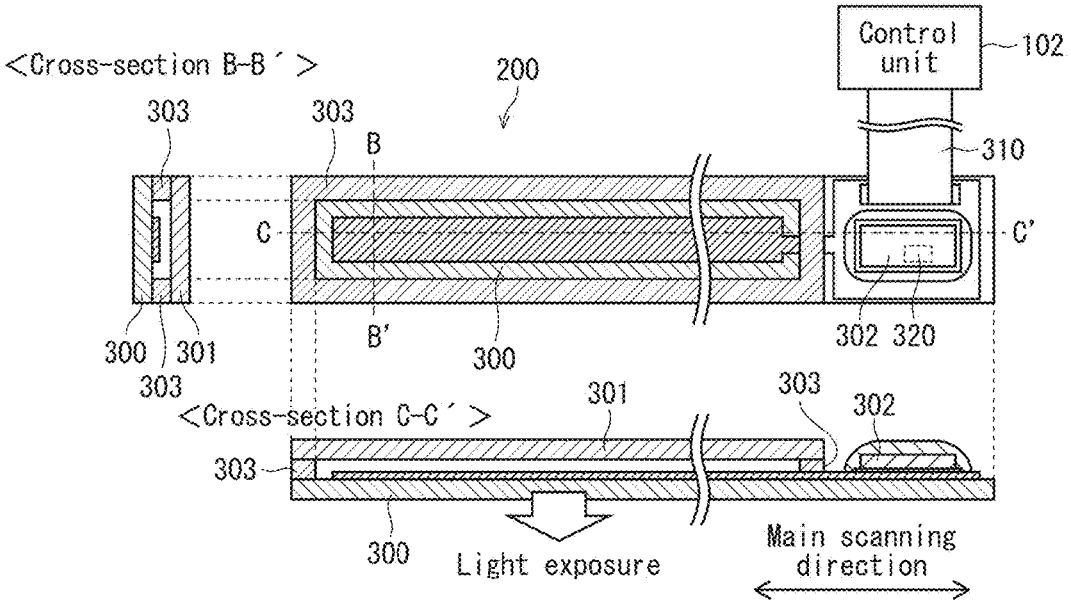
FIG. 3 includes a schematic plan view of an OLED panel 200, and in addition, a cross-sectional view taken along line A-A' and a cross-sectional view taken along line C-C'.

FIG. 3 includes a schematic plan view of the OLED panel 200 and, in addition, a cross-sectional view taken along line B-B' and a cross-sectional view taken along line C-C'. The schematic plan views illustrate the OLED panel 200 without a sealing plate 301 (described later) attached.

As illustrated in FIG. 3, the OLED panel 200 includes a thin film transistor (TFT) substrate 300, a sealing plate 301, and a driver integrated circuit (IC) 302. A great number of OLEDs 201 are linearly arranged on the TFT substrate 300 along the main scanning direction. The OLEDs 201 may be arranged in one row, or may be arranged in a zigzag pattern.

A region of the TFT substrate 300 where the OLEDs 201 are arranged is sealed by the sealing plate 301 being attached so that a spacer frame body 303 is sandwiched by the region of the TFT substrate 300 and the sealing plate 301. By providing the sealing and introducing dry nitrogen etc., the region where the OLEDs 201 are arranged is sealed and protected from ambient air. In addition, a moisture absorber may also be introduced for the purpose of absorbing moisture. The sealing plate 301 may be, for example, a sealing glass, or may be made of a material other than glass.

The driver IC 302 is mounted on the TFT substrate 300 outside the region where the OLEDs 201 are arranged. The control unit 102 inputs digital luminance signals to the driver IC 302 via a flexible wire 310. The control unit 102 has a dedicated application specific integrated circuit (ASIC) built in thereto for generating the digital luminance signals.

The driver IC 302 converts the digital luminance signals to analog luminance signals (hereinafter referred to simply as "luminance signals") and inputs the luminance signals to driving circuits provided in one-to-one correspondence with the OLEDs 201. The driving circuits generate driving currents for the OLEDs 201 in accordance with the luminance signals. The luminance signals may be current signals or voltage signals. In addition, the driver IC 302 has a built-in temperature sensor 320 that measures a surrounding temperature of the OLEDs 201.

Figure 4:
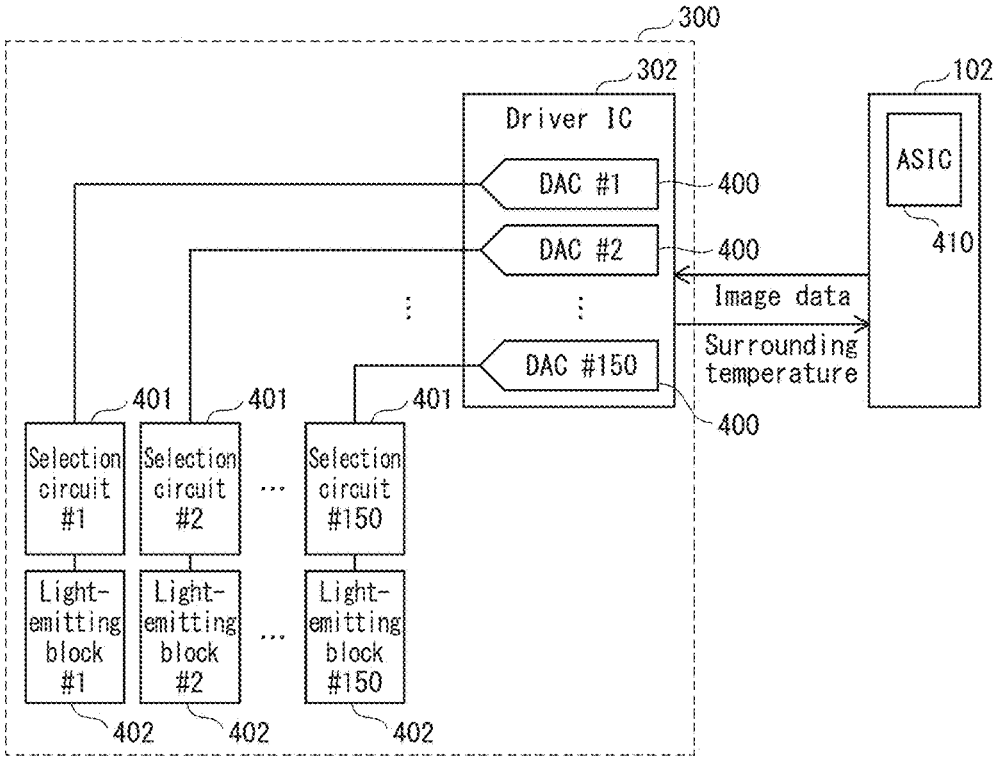
FIG. 4 is a block diagram illustrating main functional blocks of a thin film transistor (TFT) substrate 300.

As illustrated in FIG. 4, 15,000 OLEDs 201 on the TFT substrate 300 are divided into 150 light-emitting blocks 402 each containing 100 of the OLEDs 201. The OLEDs 201 may be arranged in one row along the main scanning direction at a 21.2 μm pitch, or in a zig-zag pattern. The driver IC 302 includes 150 built-in DACs 400, which correspond one-to-one to the light-emitting blocks 402. The DACs 400 are variable voltage sources that are digitally controllable.

When the driver IC 302 receives digital luminance signals representing image data for one scanning period from the ASIC 410 in the control unit 102, the luminance signals are divided into subgroups of luminance signals. Each subgroup includes luminance signals corresponding to 100 pixels, and is distributed to one of the DACs 400. The ASIC 410 acquires the surrounding temperature detected by the temperature sensor 320 from the driver IC 302.

Each circuit connecting one DAC 400 and one light-emitting block has a selection circuit 401 between the DAC 400 and the light-emitting block. Each DAC 400 outputs luminance signals successively to the 100 OLEDs 201 in a corresponding light-emitting block by a so-called rolling driving.

Figure 5:
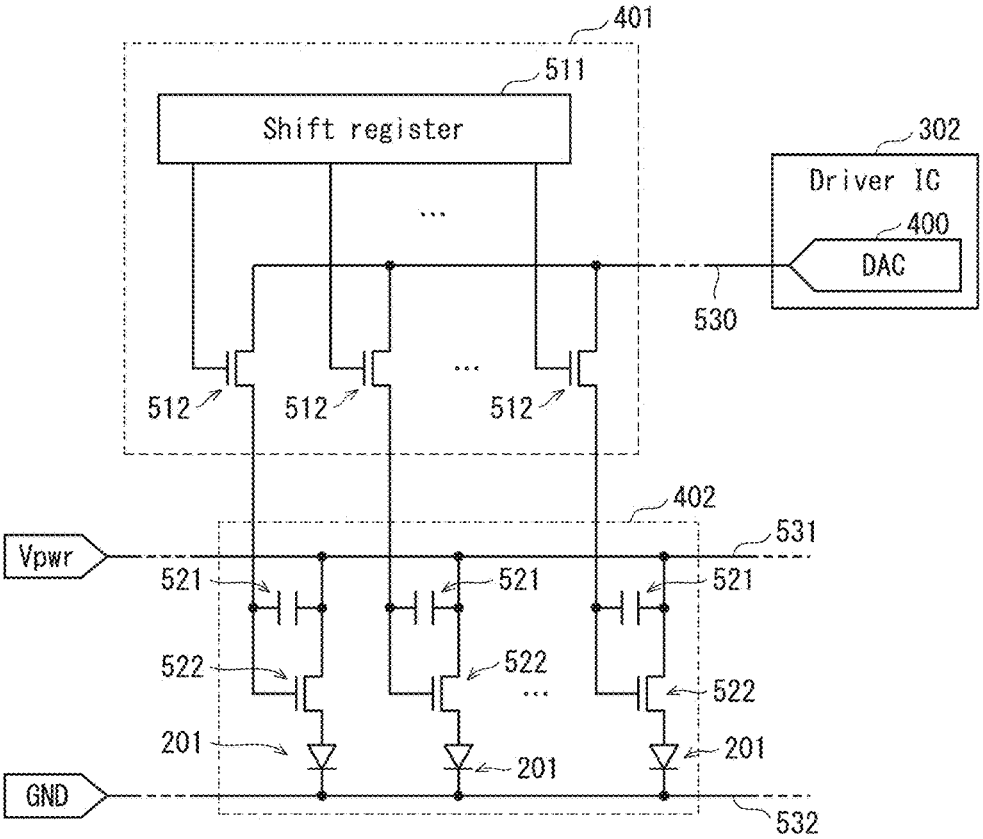
FIG. 5 is a circuit diagram illustrating a main configuration of a selection circuit 401 and a light-emitting block 402.

FIG. 5 is a circuit diagram illustrating a pair of a selection circuit 401 and a light-emitting block 402. As illustrated in FIG. 5, the light-emitting block 402 includes 100 light-emitting pixel circuits. Each of the light-emitting pixel circuits includes a capacitor 521, a driving TFT 522, and one OLED 201. The selection circuit 401 includes a shift register 511 and 100 selection TFTs 512.

The shift register 511 is connected to the respective gate terminals of the 100 selection TFTs 512, and turns on the selection TFTs 512 successively. Each selection TFT 512 has a source terminal connected to a corresponding DAC 400 via a writing wiring 530, and a drain terminal connected to a first terminal of a corresponding capacitor 521 and a gate terminal of a corresponding driving TFT 522.

When the shift register 511 turns on one selection TFT 512, voltage output from a corresponding DAC 400 is applied to and held by a first terminal of a corresponding capacitor 521. The first terminal of the capacitor 521 is also connected to a gate terminal of a corresponding driving TFT 522, and a second terminal of the capacitor 521 is connected to a source terminal of the corresponding driving TFT 522 and a power supply wiring 531.

An anode terminal of an OLED 201 is connected to a drain terminal of a corresponding driving TFT 522, and a cathode terminal of the OLED 201 is connected to a grounding wiring 532. The power supply wiring 531 is connected to a constant voltage source Vpwr, and the grounding wiring 532 is connected to a grounding terminal.

The constant voltage source Vpwr is a power source of driving current supplied to each OLED 201. Each driving TFT 522 supplies driving current to a corresponding OLED 201. The driving current amount supplied to each OLED 201 is in accordance with the voltage held between the first terminal and the second terminal of the corresponding capacitor 521. For example, when a signal corresponding to level H is written to a capacitor 521, the corresponding driving TFT 522 turns on and the corresponding OLED 201 emits light. When a signal corresponding to level L is written to a capacitor 521, the corresponding driving TFT 522 turns off and the corresponding OLED 201 does not emit light.

Meanwhile, the present embodiment describes an example in which the driving TFT 522s are p-channel TFTs, but it goes without saying that the driving TFTs 522 may be n-channel TFTs.

[3] CONFIGURATION OF ASIC 410

The following describes a configuration of the ASIC 410.

Figure 6:
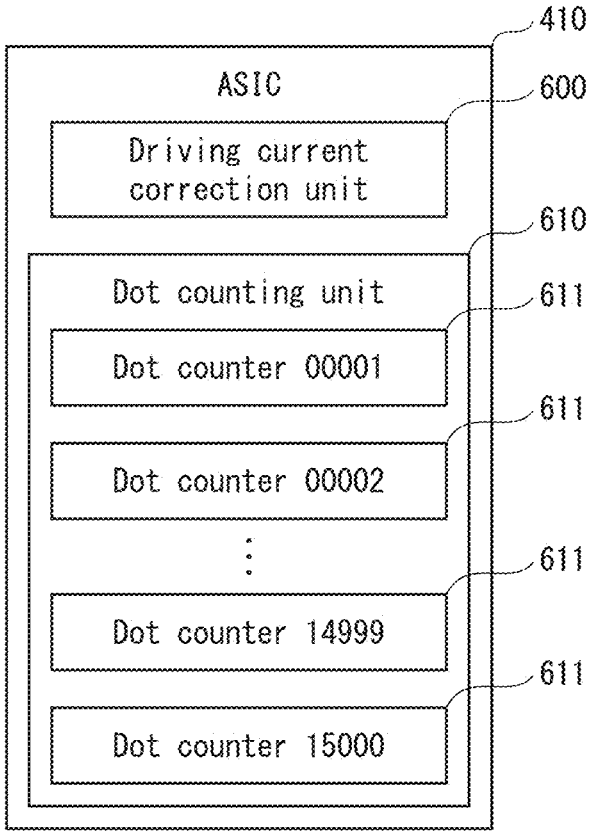
FIG. 6 is a block diagram illustrating main functional blocks of an ASIC 410.

As illustrated in FIG. 6, the ASIC 410 includes a driving current correction unit 600 and a dot counting unit 610. The dot counting unit 610 includes dot counters 611 provided in one-to-one correspondence with the OLEDs 201. Each of the dot counters 611 holds a count value and increments the count value by one each time a corresponding OLED 201 is caused to emit light.

The driving current correction unit 600 stores threshold values TH (examples illustrated in FIG. 7A) for the dot counters 611, current increase amounts a (examples illustrated in FIG. 7B), and current correction factors γ (examples illustrated in FIG. 7C). The driving current correction unit 600 corrects the digital luminance signals to be input to the driver IC 302.

Each threshold value TH is associated with one combination of a preset light amount and a surrounding temperature range. Each current increase amount α indicates an increase in target current amount expected to occur each time an OLED 201 emits light, and is associated with one combination of a preset light amount and a surrounding temperature range. Each current correction factor γ is associated with a combination of a preset light amount and a surrounding temperature range.

In the present disclosure, a plurality of preset light amounts of the OLEDs 201 are set. For example, a preset light amount to be applied when the sheet conveyance speed is full speed may differ from a preset light amount to be applied when the sheet conveyance speed is half speed. Further, the threshold values TH are used to correct the digital luminance signals. Each threshold value TH is such that, when a count value held by a dot counter 611 equals the threshold value TH, the count value is reset to zero.

The current correction factors γ are used in the correction of driving current values indicated by the digital luminance signals, which is performed when the count values of the dot counters 611 equal the threshold values TH. Specifically, FIG. 7C illustrates a plurality of current correction factors γ that are applied in sheet conveyance speed switching from full speed to half speed, and each of the current correction factors γ is associated with a different combination of one of multiple surrounding temperature ranges (surrounding temperature range A, B, C, D, or E) and one of the preset light amounts that is applied after the conveyance speed switching. Note that FIG. 7C corresponds to a case where a preset light amount of 400 $W/m^2$ is applied before the conveyance speed switching.

Further, note that each current correction factor γ in FIG. 7C represents a ratio of a driving current amount for a combination of the corresponding preset light amount and the corresponding surrounding temperature range to a driving current amount when the preset light amount is 400 $W/m^2$ and the surrounding temperature belongs to surrounding temperature range C. Therefore, in FIG. 7C, the current correction factor γ when the preset light amount is 400 $W/m^2$ and the surrounding temperature range C is "1".

[4] OPERATIONS OF ASIC 410

The following describes operations of the ASIC 410. Because the ASIC 400 executes the same operations for every OLED 201, the following describes the operations of the ASIC 400 by taking one OLED 201 as an example.

(1) Compensation for Decrease in Light Emission Efficiency Caused by Deterioration Over Time The following describes an operation of the ASIC 410 for compensating for the decrease in light emission efficiency of an OLED occurring due to deterioration of the OLED 201 over time.

Figure 8:
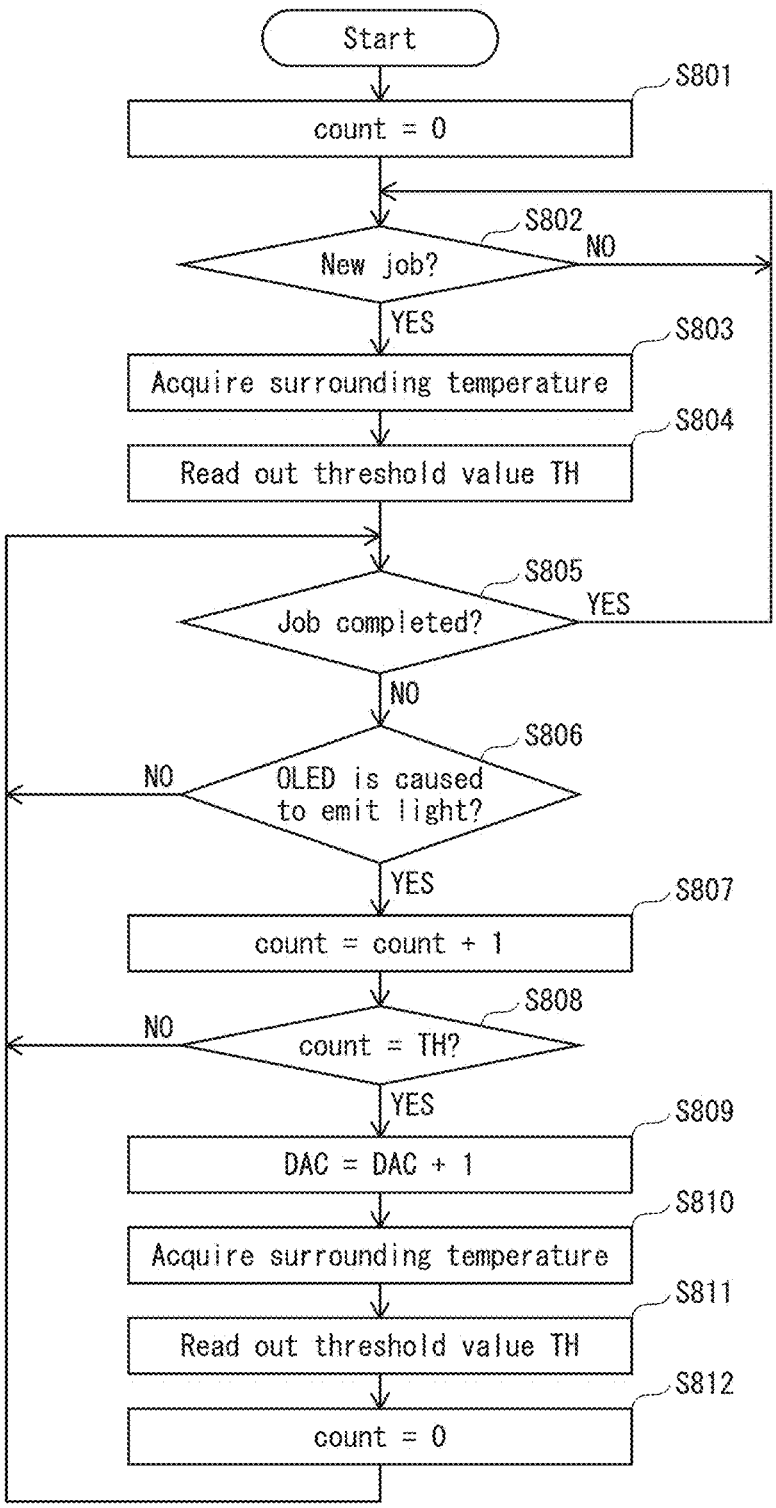
FIG. 8 is a flowchart illustrating an operation of the ASIC 410 of compensating for a decrease in light emission efficiency of an OLED 201 occurring due to deterioration of the OLED 201 over time.

As illustrated in FIG. 8, the ASIC 410 sets a count value count of the dot counter 611 corresponding to the OLED 201 to zero (S801). When a new job is received (S802:YES), the driving current correction unit 600 of the ASIC 410 acquires the surrounding temperature of the OLED 201 from the temperature sensor 320 (S803) and reads out a threshold value TH corresponding to the present surrounding temperature and the present preset light amount (S804).

When the job is completed (S805:YES), the operation proceeds to S802 and the above processes are repeated. When the job is not completed yet (S805:NO) and the OLED 201 has been caused to emit light in the job (S806:YES), the count value count is increased by one (S807).

When the count value count equals the threshold value TH (S808:YES), a digital value that is input to the corresponding DAC 400 (hereinafter referred to as a DAC value) is increased by one (S809). This increase in DAC value causes the driving current amount supplied to the OLED 201 to increase by a driving current amount I(LSB) corresponding to one LSB of the DAC value.

Further, the ASIC 410 acquires the newly-detected surrounding temperature of the OLED 201 from the temperature sensor 320 (S810), reads out a threshold value TH corresponding to the newly-detected surrounding temperature (S811), and sets the count value count to zero (S812). Then, the operation proceeds to S805 and the above processes are repeated.

Figure 9A:
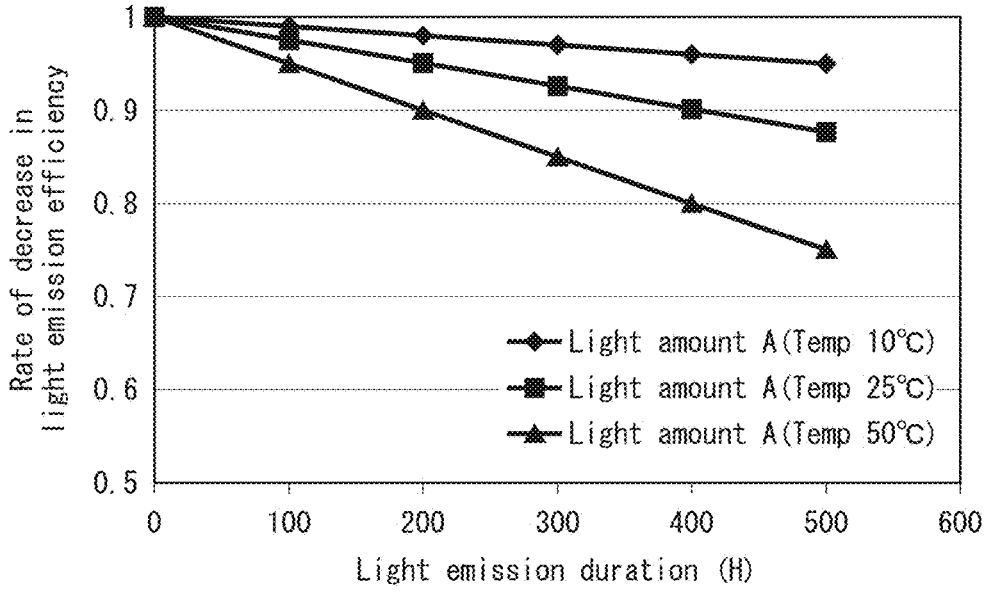
FIG. 9A includes graphs illustrating, for different light emission durations, how surrounding temperature affects a ratio of light emission efficiency of the OLED 201 after deterioration over time to an initial light emission efficiency of the OLED 201, and FIG. 9B includes graphs illustrating, for different light emission durations, how different preset light amounts affect the ratio of light emission efficiency of the OLED 201 after deterioration over time to the initial light emission efficiency of the OLED 201.
Figure 9B:
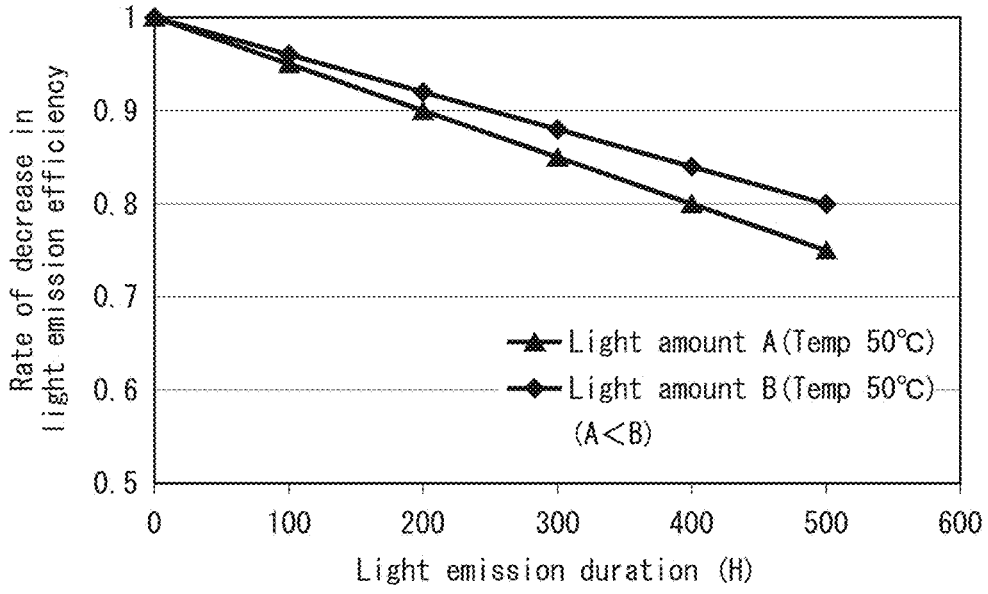

FIGS. 9A and 9B include graphs illustrating, for different light emission durations, how surrounding temperature affects a ratio of light emission efficiency of the OLED 201 after deterioration over time to an initial light emission efficiency of the OLED 201. As illustrated in FIG. 9A, the higher the surrounding temperature, the faster the rate of decrease in light emission efficiency of the OLED 201. Further, as illustrated in FIG. 9B, even if the surrounding temperature of the OLED 201 remains the same, the greater the light amount emitted by the OLED 201 (i.e., the greater the driving current amount actually supplied to the OLED 201), the faster the rate of decrease in light emission efficiency of the OLED 201. Note that in FIG. 9B, light amount A is smaller a light amount than light amount B. Accordingly, the higher the present surrounding temperature of the OLED 201, the lower the threshold value TH applied. Also, the greater the present preset light amount of the OLED 201, the lower the threshold value TH applied.

Figure 10:
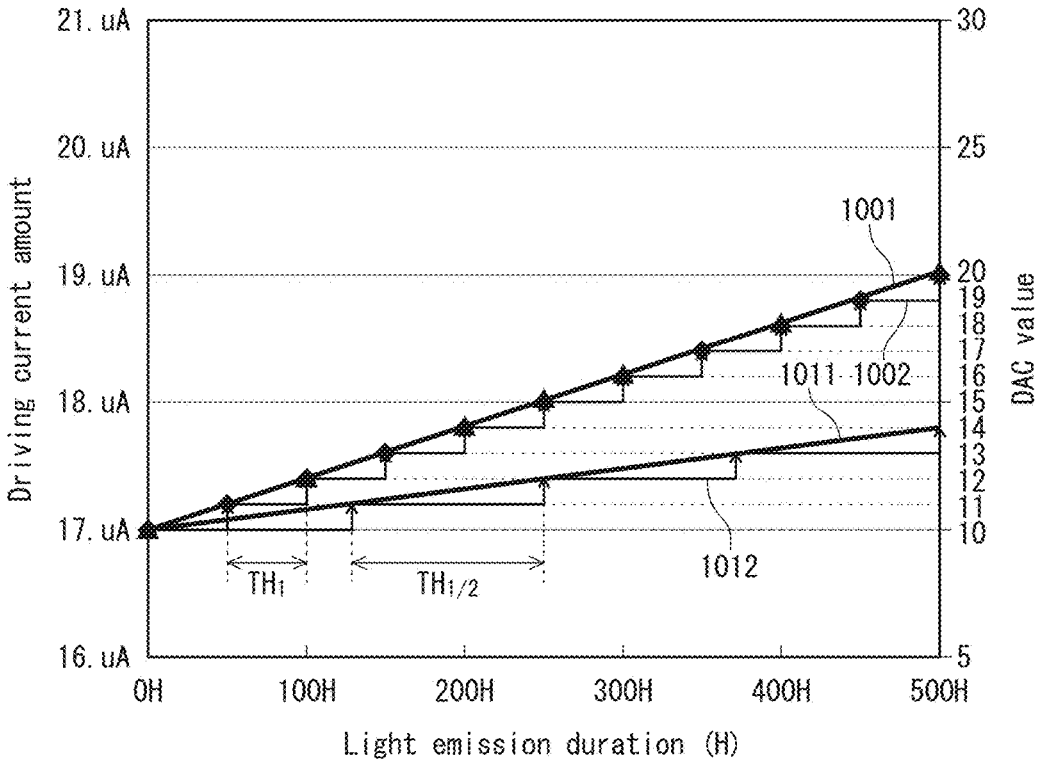
FIG. 10 includes graphs exemplifying a target current amount in full speed and a target current amount in half speed, and an actual current amount (DAC value) in full speed and an actual current amount (DAC value) in half speed.

FIG. 10 includes graphs exemplifying, for each of a preset light amount when the sheet conveyance speed is full speed and a preset light amount when the sheet conveyance speed is half speed, a target current amount for keeping the OLED 201 emitting the present light amount and an actual current amount (corresponding to the DAC value) actually supplied to the OLED. Graphs 1001 and 1011 in FIG. 10 illustrate that the target current amount increases as the amount of time for which the OLED 201 performs light emission increases. Meanwhile, because the DAC value can only be increased one bit at a time, the actual current amount increases as illustrated by graphs 1002 and 1012 in FIG. 10. Specifically, graph 1002 indicates that when the sheet conveyance speed is full speed, the DAC value is increased by one bit each time the count value count for the OLED 201 equals a threshold value $TH_1$.

Here, it should be noted that the preset light amount when the sheet conveyance speed is half speed is lower than the preset light amount when the sheet conveyance speed is full speed because the rotation of the photoreceptor drum 110 is slower and the photoreceptor drum 110 receives light for a longer amount of time when the sheet conveyance speed is half speed as compared to when the sheet conveyance speed is full speed. Because of this, the increase in target current amount for keeping the OLED 201 emitting the preset light amount when the sheet conveyance speed is half speed, which is indicated by graph 1011, is less rapid compared to the increase in target current amount for keeping the OLED 201 emitting the preset light amount when the sheet conveyance speed is full speed, which is indicated by graph 1001. Further, graph 1012 indicates that when the sheet conveyance speed is half speed, the DAC value is increased by one bit each time the count value count for the OLED 201 equals a threshold value $TH_{1/2}$, which is greater than the threshold value $TH_1$.

(2) Switching from One Preset Light Amount to Another

The following describes an operation of the ASIC 410 for switching the light amount of the OLED 201 from one preset light amount to another, taking as an example an operation of the ASIC 410 upon conveyance speed switching from full speed to half speed.

Figure 11:
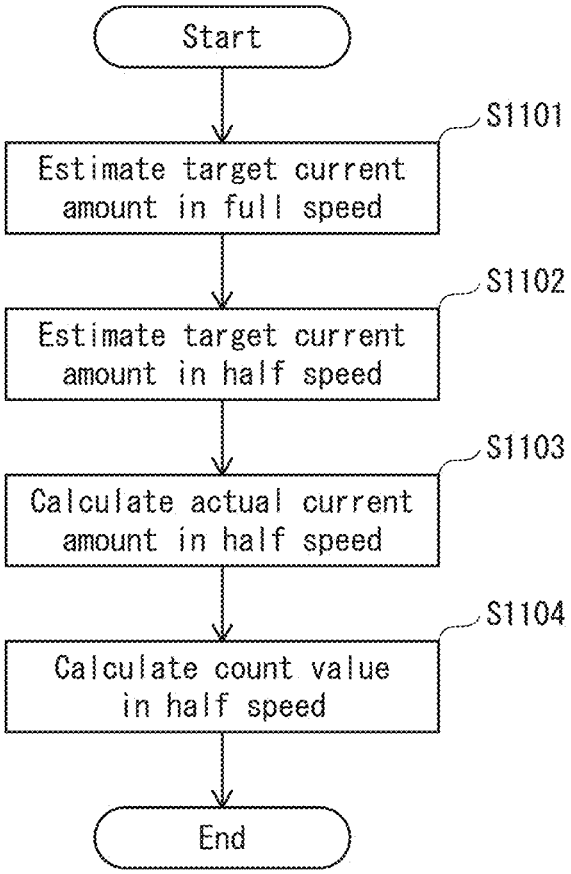
FIG. 11 is a flowchart illustrating an operation of the ASIC 410 upon preset light amount switching.

As illustrated in FIG. 11, the ASIC 410 first estimates the present target current amount I(a) by using the following equation (S1101).

$$I(a)=\mathrm{DAC}(a)\times I(\mathrm{LSB})+\alpha(400C)\times\mathrm{count}(a)\square(\square)= \square\square\square(\square)\times\square(\square\square\square)+\square(400\square)\times\square\square\square\square\square(\square) \quad (1)$$

Specifically, the ASIC 410 estimates the present target current amount by (i) calculating the present actual current amount by multiplying DAC(a), which indicates the present DAC value, by the driving current amount I(LSB); (ii) calculating the increase in target current amount at count value count(a), which is the present count value of the corresponding dot counter 611 and indicates the number of times up until the present point the OLED 201 has been caused to emit light by being supplied with the present actual current amount, by multiplying current increase amount α(400 C), which indicates the current increase amount necessary for compensating for the deterioration of the OLED 201 occurring each time the OLED 201 emits light, by the count value count(a); and (iii) adding the present actual current amount and the increase in target current amount at count value count(a).

Here, the ASIC may read out the current increase amount necessary for compensating for the deterioration of the OLED 201 occurring when the OLED 201 emits light once (current increase amount α(400 C) in this example) from the table in FIG. 7B, by using (i) the temperature range including the surrounding temperature that was acquired from the temperature sensor 320 the last time the count value of the corresponding dot counter 611 was set to zero (the temperature range C in this example) and (ii) the preset light amount when the sheet conveyance speed is full speed (400 W/m$^2$ in this example).

Next, the ASIC 410 estimates a target current amount I(b) after the conveyance speed switching by using the following equation (S1102).

$$I(b)=\gamma(200C)\times I(a) \quad (2)$$

Here, the ASIC 410 may read out the current correction factor (the current correction factor γ(200 C) in this example) from the table in FIG. 7C by using (i) the temperature range including the surrounding temperature that was acquired from the temperature sensor 320 the last time the count value of the corresponding dot counter 611 was set to zero (the temperature range C in this example) and (ii) the preset light amount when the sheet conveyance speed is half speed (200 W/m$^2$ in this example). The current amount I(a) is the value estimated by using formula (1) above.

Then, DAC(b), which indicates a DAC value after the conveyance speed switching, is calculated by using the following equation (S1103).

$$\mathrm{DAC}(b)=[I(b)/I(\mathrm{LSB})] \quad (3)$$

Here, the square bracket notation indicates Gauss notation, and represents an integer portion of the value inside the square brackets. Therefore, equation (3) indicates an integer portion of a value obtained by dividing the target current amount I(b) after the conveyance speed switching by driving current amount I(LSB) corresponding to one LSB of a DAC value. Thus, DAC(b) is one of the DAC values each corresponding to a current amount equal to or smaller than the target current amount I(b) after the conveyance speed switching that is closest to the target current amount I(b) after the conveyance speed switching.

Finally, a count value count(b), which indicates the count value from which the corresponding dot counter 611 resumes the count after the conveyance speed switching, is calculated by using the following equation (S1104).

$$\mathrm{count}(b)=\{I(b)-I(\mathrm{LSB})\times\mathrm{DAC}(b)\}/a(200C) \quad (4)$$

Specifically, the count value count(b) is calculated by: (i) calculating the actual current amount after the conveyance speed switching by multiplying the DAC value DAC(b) calculated in S1103 by driving current amount I(LSB); (ii) calculating a difference between the target current amount I(b) after the conveyance speed switching and the actual current amount after the conveyance speed switching; and dividing this difference by the current increase amount necessary for compensating for the deterioration of the OLED 201 occurring each time the OLED 201 emits light (current increase amount α(200C) in this example). The count value count(b) calculated in such a manner corresponds to a difference between the threshold value TH applied after the conveyance speed switching and a count value corresponding to the next time point when the actual current amount after the conveyance speed switching is expected to equal the target current amount after the conveyance speed switching.

Thus, by causing the dot counter 611 to resume the count from the count value count(b) calculated by using equations (1), (2), (3), and (4) above, the target current amount and the actual current amount equal one another the next time the count value of the dot counter 611 equals the threshold value TH applied after the conveyance speed switching.

[5] EXAMPLES OF SWITCHING OPERATION

The following describes examples of the operation of the ASIC 410 upon conveyance speed switching from full speed to half speed.

(1) When Target Current Amount and Actual Current Amount Equal Each Other Upon Conveyance Speed Switching The following describes a case where the target current amount I(a) and an actual current amount $I_{real}$ supplied to the OLED 201 are equal at the point of the conveyance speed switching.

Here, suppose that the driving current amount I(LSB) is 0.2 μA, the DAC value DAC(a) at the point of conveyance speed switching is 15, and the count value count(a) at the point of conveyance speed switching is zero. Further, in the following, it is supposed that the actual current amount $I_{real}$ at the point of sheet conveyance switching includes a bias component $I_{bias}$ of 15 μA. Accordingly, the actual current amount $I_{real}$ at the point of sheet conveyance switching is 18 μA, which is obtained by multiplying driving current amount I(LSB) by DAC value DAC(a) and then adding the bias component of 15 μA, as indicated by the following equation.

$$I_{real}=I_{DAC}+I_{bias}=I(\mathrm{LSB})\times\mathrm{DAC}(a)+I_{bias}=0.2\ \mu\mathrm{A}\times 15+ 15\ \mu\mathrm{A}=18\ \mu\mathrm{A}\mathrm{DAC}(a)=(I(a)-15\ \mu\mathrm{A})\div 0.2\ \mu\mathrm{A}= (18\ \mu\mathrm{A}-15\ \mu\mathrm{A})\div 0.2\ \mu\mathrm{A}=15 \quad (5)$$

Further, because the count value count(a) at the point of conveyance speed switching is zero, the target current amount I(a) equals the actual current amount $I_{real}$ at the point of sheet conveyance switching That is, the current amount I(a) at the point of conveyance speed switching is also 18 μA.

Here, when supposing that a current correction factor γ of 0.8 is to be applied at the point of conveyance speed switching, the target current amount I(b) after the conveyance speed switching is calculated as follows.

$$I(b)=\gamma\times(I(a)-I_{bias})+I_{bias}=0.8\times(18\ \mu A-15\ \mu A)+15\ \mu A=17.4\ \mu A \quad (6)$$

From this, the DAC value DAC(b) after the conveyance speed switching, which is calculated as follows, is a divisible value.

$$DAC(b)=(I(b)-15\ \mu A)/0.2\ \mu A=(17.4\ \mu A-15\ \mu A)/0.2\ \mu A=12 \quad (7)$$

Because the target current amount I(b) after the conveyance speed switching and the actual current amount after the conveyance speed switching equal each other, count value count(b) of zero is set to the corresponding dot counter 611.

On the other hand, when supposing that a current correction factor γ of 0.75 is to be applied at the point of conveyance speed switching, the target current amount I(b) after the conveyance speed switching is calculated by as follows.

$$I(b)=\gamma\times(I(a)-I_{bias})+I_{bias}=0.75\times(18\ \mu A-15\ \mu A)+15\ \mu A=17.25\ \mu A \quad (8)$$

From this, the DAC value DAC(b) after the conveyance speed switching is calculated as follows.

$$\begin{aligned} DAC(b) &= [(I(b)-15\ \mu A/0.2\ \mu A] \quad (9)\\ &= [(17.25\ \mu A-15\ \mu A)/0.2\ \mu A]\\ &= [11.25]\\ &= 11 \end{aligned}$$

$$DAC(b) = [(I(b)-15\ \mu A)\div 0.2\ \mu A] = [(17.25\ \mu A-15\ \mu A)\div 0.2\ \mu A] = [11.25] = 11$$

In this case, the DAC value DAC(b) is a value obtained by rounding down the value in the square brackets. Thus, a quantization error that corresponds to the decimal portion of the value in the square brackets is produced between the target current amount I(b) after the conveyance speed switching and the actual current amount after the conveyance speed switching.

Figure 12:
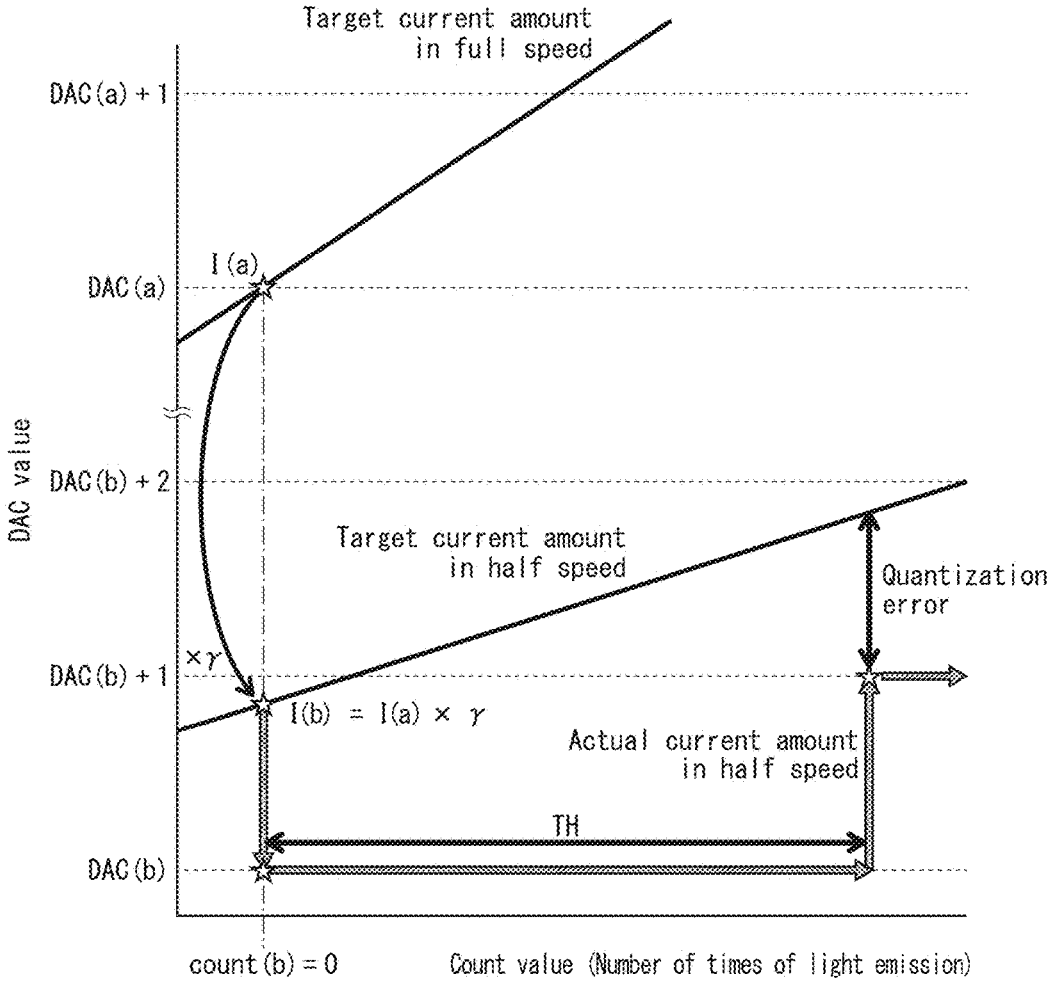
FIG. 12 is a graph describing preset light amount switching pertaining to conventional technology.

Here, it should be noted that such a quantization error remains present even after the count value of the corresponding dot counter 611 is set to zero. Because of this, as illustrated in FIG. 12, the actual current amount does not equal the target current amount I(b) even when the count value of the corresponding dot counter 611 equals the threshold value TH applied after the conveyance speed switching Therefore, after the conveyance speed switching, the OLED 201 does not emit the preset light amount in half speed.

Accordingly, due to the OLED 201 emitting a smaller light amount than ones of the OLEDs 201 emitting the preset light amount in half speed after the conveyance speed switching, image unevenness in the form of stripes appear in printed images.

Figure 13:
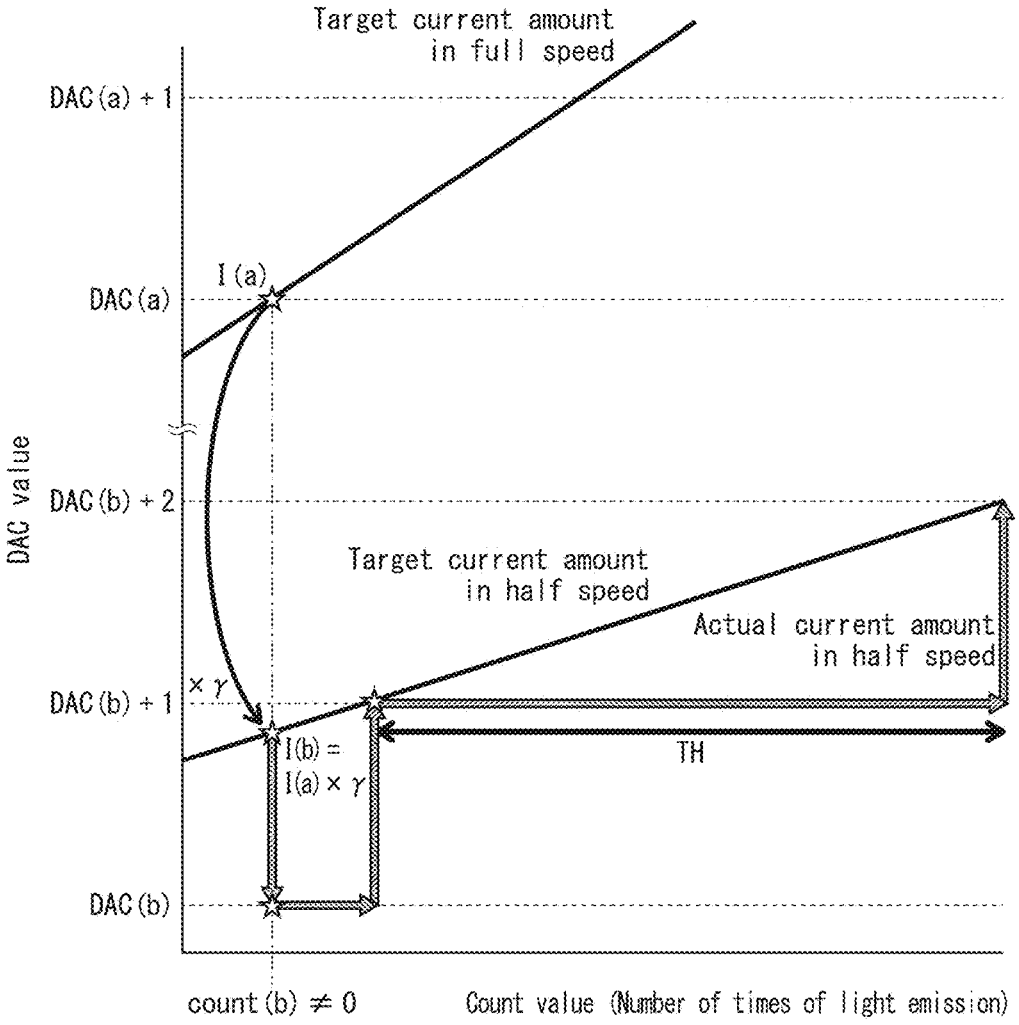
FIG. 13 is a graph describing preset light amount switching pertaining to the embodiment.

Meanwhile, according to the configuration pertaining to the present embodiment, the count value count(b) calculated according to equation (4), from which the corresponding dot counter 611 resumes the count after the conveyance speed switching, corresponds to a difference between the threshold value TH applied after the conveyance speed switching and a count value corresponding to the next time point when the actual current amount after the conveyance speed switching is expected to equal the target current amount after the conveyance speed switching. Accordingly, the next time the count value of the dot counter 611 equals the threshold value TH applied after the conveyance speed switching, the target current amount and the actual current amount equal each other as illustrated in FIG. 13.

(2) When Target Current Amount and Actual Current Amount do not Equal Each Other Upon Conveyance Speed Switching The following describes a case where the target current amount and the actual current amount are not equal at the point of the conveyance speed switching.

Here, suppose that the driving current amount I(LSB) is 0.2 μA, a current correction factor γ of 0.8 is to be applied, the DAC value DAC(a) at the point of conveyance speed switching is 14, the count value count(a) at the point of conveyance speed switching is 90, and the current increase amount α increased for compensating for the deterioration of the OLED 201 occurring each time the OLED 201 emits light is 0.002 μA at the point of conveyance speed switching. In this case, the target current amount I(a) at the point of conveyance speed switching is calculated as follows by using equation (1) above.

$$I(a)=0.2\ \mu A\times 14+0.002\ \mu A\times 90+15\ \mu A=17.98\ \mu A I(\alpha)=0.2\ \mu A\times 14+0.002\ \mu A\times 90+15\ \mu A=17.98\ \mu A \quad (10)$$

From this, the target current amount I(*b*) immediately after the conveyance speed switching is calculated as follows.

$$I(b)=0.8\times(17.98\ \mu A-15\ \mu A)+15\ \mu A=17.384\ \mu A I(b)=0.8\times(17.98\ \mu A-15\ \mu A)+15\ \mu A=17.38\ \mu A \quad (11)$$

Accordingly, the DAC value DAC(b) after the conveyance speed switching is calculated as follows.

$$DAC(b)=[(17.384\ \mu A-15\ \mu A)/0.2\ \mu A]=[11.92]=11 \quad (12)$$

Here, the square bracket notation is used again. As such, a quantization error that corresponds to the decimal portion of the value in the square brackets is produced between the target current amount I(b) after the conveyance speed switching and the actual current amount after the conveyance speed switching also in this case. As in conventional technology, this quantization error remains present even after the count value of the corresponding dot counter 611 is set to zero. Accordingly, image unevenness in the form of stripes appears in printed images. Meanwhile, according to the configuration pertaining to the present embodiment, the count value count(b) is calculated according to equation (4). Thus, the configuration pertaining to the present embodiment suppresses the occurrence of image unevenness in the form of stripes in printed images and achieves high image quality.

[6] MODIFICATIONS

Up to this point, description has been provided based on an embodiment of the present invention. However, it goes without saying that the present invention should not be construed as being limited to the embodiment. That is, modifications such as those described in the following should be construed as being within the spirit and scope of the present invention.

(1) In the embodiment, description is provided of a case where conveyance speed switching from full speed to half speed is executed, but it goes without saying that the present invention should not be construed as being limited to this. Applying the present invention when conveyance speed switching from half speed to full speed is executed can also achieve a similar effect.

Specifically, when making this modification, a target current amount $I_{prev}$ before the conveyance speed switching (i.e. target current amount in half speed) is calculated by using the following equation (13), which is similar to equation (1).

$$I_{prev}=DAC_{prev}\times=I(LSB)+\alpha\times count_{prev}I_{prev}=DAC_{prev}\times I(LSB)+\alpha\times count_{prev} \quad (13)$$

Here, the DAC value $DAC_{prev}$ indicates the DAC value before the conveyance speed switching, the driving current amount I(LSB) indicates a driving current amount per one LSB of a DAC value, $\alpha$ indicates a current increase amount increased for compensating for the deterioration of the OLED 201 occurring each time the OLED 201 emits light, and $count_{prev}$ indicates the count value of the corresponding dot counter 611 before the conveyance speed switching.

Next, a target current amount $I_{post}$ after the conveyance speed switching (i.e. in full speed) is calculated by using equation (14), which is similar to equation (2).

$$I_{post}=\gamma\lambda I_{prev}I_{post}=\gamma\times I_{prev} \quad (14)$$

Here, $\gamma$ indicates a current correction factor stored beforehand. Further, the DAC value $DAC_{post}$ after the conveyance speed switching is calculated from the target current amount $I_{post}$, by using equation (15), which is similar to equation (3).

$$DAC_{post}=[I_{post}/I(LSB)]DAC_{post}=[I_{post}\div I(LSB)] \quad (15)$$

Finally, the count value $count_{post}$ after the sheet conveyance switching is calculated by using equation (16), which is similar to equation (4).

$$count_{post}=\{I_{post}-I(LSB)\times DAC_{post}\}/\alpha count_{post}=\{I_{post}-I(LSB)\times DAC_{post}\}/\alpha \quad (16)$$

Here, $\alpha$ indicates a current increase amount stored beforehand that is increased for compensating for the deterioration of the OLED 201 occurring each time the OLED 201 emits light. It goes without saying that the value of the current correction factor $\gamma$ and the value of the current increase amount $\alpha$ may be changed in accordance with surrounding temperature, preset light amount, etc.

Figure 14:
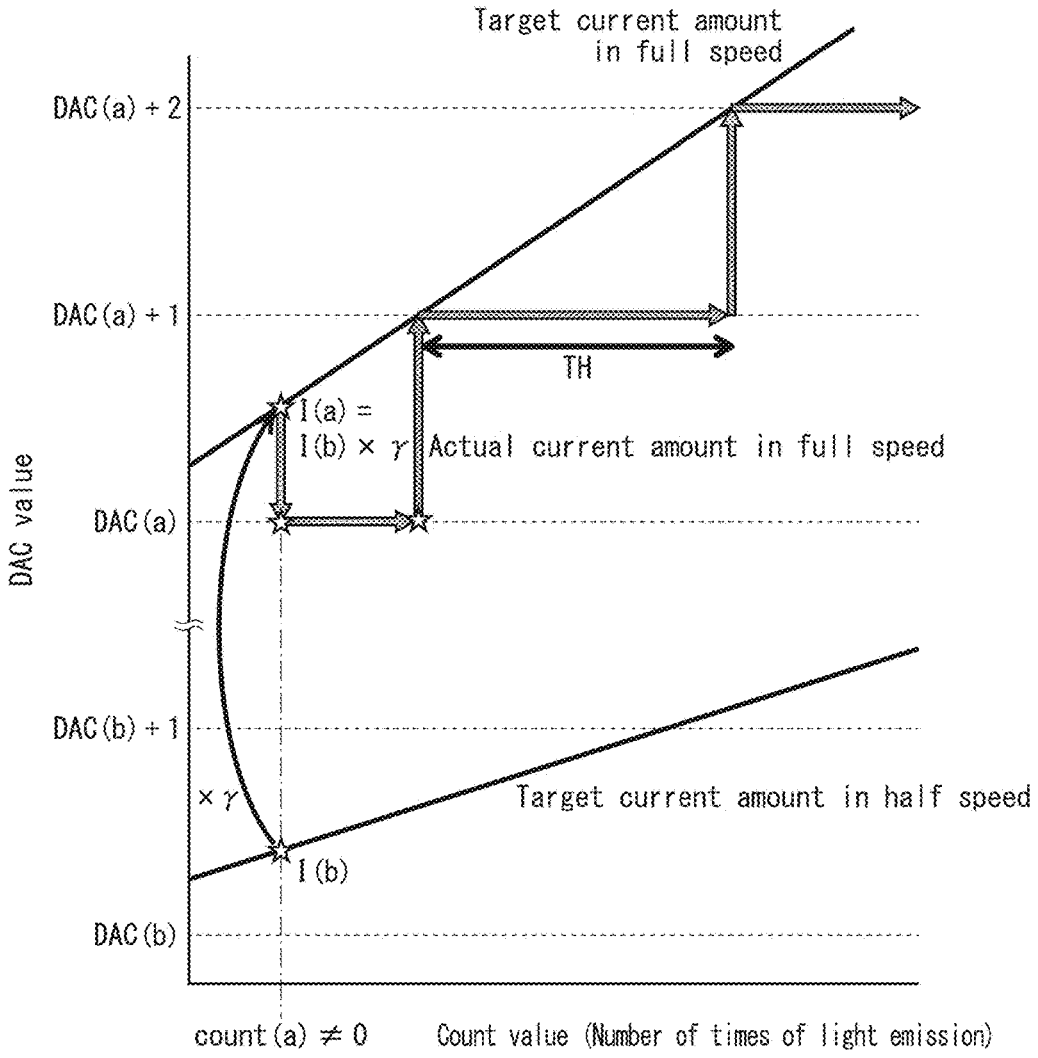
FIG. 14 is a graph describing preset light amount switching pertaining to a modification of the present invention.

As described above, the present invention can be applied when conveyance speed switching from half speed to full speed is executed and achieves an effect similar to the effect of the embodiment, as illustrated in FIG. 14. Further, as can be seen from the present modification, the present invention can be applied when switching from one preset light amount to another is performed for purposes other than the conveyance speed switching, so as to improve image quality.

(2) In the embodiment, description is provided of a case where the number of times the OLED 201 has emitted light is counted up from the count value count(b) calculated by using equation (4), and the next time the count value of the corresponding dot counter 611 reaches a threshold value TH, the DAC value DAC(b) is increased by one. However, it goes without saying that the present invention should not be construed as being limited to this, and the following modification is possible, for example. That is, instead of counting up to a threshold value TH from the count value count(b), a value obtained by subtracting the value calculated by using equation (4) from the threshold value TH may be set as a new threshold value, and the dot counter 611 may count up to this new threshold value from zero. Here, it should be noted that the dot counter 611 performs the count the same number of times, regardless of whether the configuration of the embodiment is applied or the configuration of this modification is applied.

Further, in the embodiment, description is provided of a case where the dot counter 611 counts up from zero to a threshold value TH. Alternatively, a modification may be made such that the dot counter 611 counts down from the threshold value TH to zero, and the DAC value DAC(b) is increased by one when the count value of the dot counter 611 equals zero.

Regardless of how the number of times that the OLED 201 has emitted light is counted, similar effects as described in the embodiment can be achieved by increasing the DAC value DAC(b) by one when the count value of the dot counter 611 equals a value obtained by subtracting the count value count(b), calculated by using equation (4) upon switching from one preset light amount to another, from a threshold value TH.

(3) In the embodiment, description is provided of a case where a target current amount I(b) in half speed, which is the target current amount after switching from one preset light amount to another, is calculated by using a target current amount I(a) in full speed, which is the target current amount before switching from one preset light amount to another. However, it goes without saying that the present invention should not be construed as being limited to this, and the target current amount after switching from one preset light amount to another may be calculated in a different manner.

Further, in the embodiment, description is provided of a case where both a target current amount before switching from one preset light amount to another and a target current amount after switching from one preset light amount to another are calculated, but it goes without saying that the present invention should not be construed as being limited to this. Only one of a target current amount before switching from one preset light amount to another and a target current amount after switching from one preset light amount to another may be calculated.

(4) In the embodiment, description is provided of a case where a plurality of LUTs each storing a different type of information (i.e., count value thresholds TH in FIG. 7A, current increase amounts a indicating the current amount increasing each time an OLED 201 emits light in FIG. 7B, and current correction factors $\gamma$ in FIG. 7C) are provided. However, it goes without saying that the present invention should not be construed as being limited to this. Instead of providing such LUTs, such information (e.g., threshold values TH) may be calculated by using a function including a variable for preset light amount and a variable for surrounding temperature range.

Further, in a case where OLED characteristics change in accordance with light emission duration, a LUT storing such information (e.g., threshold values TH) may be provided for each of a plurality of light emission durations. Further, in such a case, such information (e.g., threshold values TH) may be calculated by using a function including, in addition to a variable for preset light amount and a variable for surrounding temperature range, a variable for light emission duration.

Further, the values to be stored in LUTs, the functions described above, etc., can be determined beforehand by experiments.

(5) In the embodiment, description is provided of a case the ASIC 410, which is included in the control unit 102 of the image forming device 1, performs the calculation of a count value upon switching from one preset light amount to another. However, it goes without saying that the present invention should not be construed as being limited to this. Instead, the calculation may be executed by the driver IC 302. The present invention can achieve a similar effect when the calculation of a count value upon switching from one preset light amount to another is performed by the driver IC 302.

(6) In the embodiment, description is provided of a case where the light emission duration of an OLED 201 is determined by counting number of times the OLED 201 has emitted light (count value), but it goes without saying that the present invention should not be construed as being limited to this. Instead of the number of times the OLED 201 has emitted light, the light emission duration itself can be measured. In such a case, it is desirable that the threshold values TH stored indicate light emission durations.

(7) In the embodiment, the image forming device 1 is a color printer device of a tandem type. However, it goes without saying that the present invention should not be construed as being limited to this. The present invention achieves similar effects when applied to monochrome printers and color printers of types other than a tandem type. Further, the present invention is effective for single-function peripherals such as copiers including a scanner device, facsimile devices having a communication function, and multi-function peripherals (MFPs) including all such functions.

[7] SUMMARY

As described in the embodiment, one aspect of the present invention is an optical writing device performing optical writing by using a light-emitting element and capable of performing switching of a light amount of the light-emitting element between a plurality of preset light amounts, light emission efficiency of the light-emitting element decreasing as light-emission time increases, a driving current amount required for keeping the light-emitting element emitting one light amount increasing as light-emission time increases, the optical writing device including: a first target current value estimation unit estimating a first target current value corresponding to a driving current amount required for causing the light-emitting element to emit a first light amount immediately after the switching, the first light amount being one of the preset light amounts that is utilized after the switching; a first light emission control unit supplying to the light-emitting element, from immediately after the switching, a driving current amount corresponding to a first digital value acquired by quantizing the first target current value, and causing the light-emitting element to emit light; a time amount estimation unit estimating a time amount through which a driving current amount required for keeping the light-emitting element emitting the first light amount increases from the driving current amount required for causing the light-emitting element to emit the first light amount immediately after the switching to a driving current amount corresponding to a second digital value greater than the first digital value by one step; and a second light emission control unit supplying to the light-emitting element, when the time amount elapses after the switching, the driving current amount corresponding to the second digital value, and causing the light-emitting element to emit light.

According to this structure, the light-emitting element is caused to emit light by being supplied with a driving current amount corresponding to a digital value increased by one step when a driving current amount required for keeping the light-emitting element emitting the preset light amount after switching has increased by a driving current amount corresponding to one step due to the decrease in light emission efficiency. Thus, compared with a structure in which driving current amount is increased by a driving current amount corresponding to one step each time a predetermined time amount elapses, the difference between the preset light amount set to the light-emitting element and the light amount actually emitted by the light-emitting element is smaller with this structure. Accordingly, the structure of one aspect of the present invention reduces difference in light amounts emitted by light-emitting elements, prevents the occurrence of image unevenness in the form of stripes in printed images, and achieves high image quality.

Another aspect of the present invention is an optical writing device performing optical writing by using a light-emitting element and capable of performing switching of a light amount of the light-emitting element between a plurality of preset light amounts, light emission efficiency of the light-emitting element decreasing as light-emission time increases, a driving current amount required for keeping the light-emitting element emitting one light amount increasing as light-emission time increases, the optical writing device including: a target current value estimation unit estimating, based on light-emission time, a target current value corresponding to a driving current amount required for causing the light-emitting element to emit, immediately before the switching, a light amount that is utilized before the switching among the preset light amounts.

Also, the optical writing device pertaining to one aspect of the present invention may further include a second target current value estimation unit estimating, based on light-emission time, a second target current value corresponding to a driving current amount required for causing the light-emitting element to emit a second light amount immediately before the switching, the second light amount being one of the preset light amounts that is utilized before the switching. In the optical writing device, the first target current value estimation unit may estimate the first target current value based on (i) the second target current value and (ii) a conversion factor in accordance with the first and second light amounts.

Also, the optical writing device pertaining to another aspect of the present invention may further include: a light-emission time measuring unit measuring a time amount for which the light-emitting element is caused to emit light by being supplied with a driving current amount corresponding to one digital value; and a correction factor storing unit storing a correction factor that is in accordance with the decrease in light emission efficiency. In the optical writing device, the target current value estimation unit estimates the target current value by adding, to a product yielded by multiplying the time amount measured by the light-emission time measuring unit and the correction factor, the driving current amount corresponding to the one digital value.

Also, the optical writing device pertaining to one aspect of the present invention may further include: a light-emission time measuring unit measuring a time amount for which the light-emitting element is caused to emit light by being supplied with a driving current amount corresponding to one digital value; and a correction factor storing unit storing a correction factor that is in accordance with the decrease in light emission efficiency. In the optical writing device, the second target current value estimation unit estimates the second target current value by adding, to a product yielded by multiplying the time amount measured by the light-emission time measuring unit and the correction factor, the driving current amount corresponding to the one digital value.

Also, the optical writing device pertaining to one aspect of the present invention may further include a conversion factor storage unit storing the conversion factor in accordance with the first and second light amounts. In the optical writing device, the first target current value estimation unit may estimate the first target current value based on (i) the second target current value and (ii) the conversion factor in accordance with the first and second light amounts, which is stored in the conversion factor storage unit.

Also, the optical writing device pertaining to one aspect of the present invention may further include: a second target current value estimation unit estimating, based on light-emission time, a second target current value corresponding to a driving current amount required for causing the light-emitting element to emit a second light amount immediately before the switching, the second light amount being one of the preset light amounts that is utilized before the switching; and a function storage unit storing a function allowing estimating the first target current value based on the second target current value. In the optical writing device, the first target current value estimation unit may estimate the first target current value based on the second target current value by using the function stored in the function storage unit.

Also, the optical writing device pertaining to one aspect of the present invention may further include an increase amount storage unit storing an increase amount for compensating for a decrease in light emission efficiency of the light-emitting element occurring each time the light-emitting element is caused to emit light. In the optical writing device, the time amount estimation unit may estimate the time amount by calculating a difference between the driving current amount required for causing the light-emitting element to emit the first light amount immediately after the switching and the driving current amount corresponding to the second digital value, and dividing the difference by the increase amount.

Also, the optical writing device pertaining to one aspect of the present invention may further include a temperature acquisition unit acquiring a value indicating a temperature of the light-emitting element. In the optical writing device, the increase amount storage unit may store the increase amount in plurality, one for each of a plurality of values each corresponding to a different temperature of the light-emitting element, and the time amount estimation unit may estimate the time amount by dividing the difference by using one of the plurality of increase amounts that corresponds to the value acquired by the temperature acquisition unit.

In the optical writing device pertaining to one aspect of the present invention, the time amount estimation unit may estimate the time amount by estimating the number of times the light-emitting element emits light before the driving current amount required for keeping the light-emitting element emitting the first light amount increases from the driving current amount required for causing the light-emitting element to emit the first light amount immediately after the switching to the driving current amount corresponding to the second digital value.

In the optical writing device pertaining to another aspect of the present invention, the light-emission time measuring unit may measure the time amount for which the light-emitting element is caused to emit light by being supplied with a driving current amount corresponding to one digital value by counting the number of times the light-emitting element is caused to emit light by being supplied with a driving current amount corresponding to one digital value.

In the optical writing device pertaining to one aspect of the present invention, the light-emission time measuring unit may measure the time amount for which the light-emitting element is caused to emit light by being supplied with a driving current amount corresponding to one digital value by counting the number of times the light-emitting element is caused to emit light by being supplied with a driving current amount corresponding to one digital value.

In the optical writing device pertaining to one aspect of the present invention, the light-emitting element may be an organic light-emitting diode.

In the optical writing device pertaining to another aspect of the present invention, the light-emitting element may be an organic light-emitting diode.

Yet another aspect of the present invention is an image forming device including an optical writing device performing optical writing by using a light-emitting element and capable of performing switching of a light amount of the light-emitting element between a plurality of preset light amounts, light emission efficiency of the light-emitting element decreasing as light-emission time increases, a driving current amount required for keeping the light-emitting element emitting one light amount increasing as light-emission time increases, the optical writing device including: a first target current value estimation unit estimating a first target current value corresponding to a driving current amount required for causing the light-emitting element to emit a first light amount immediately after the switching, the first light amount being one of the preset light amounts that is utilized after the switching; a first light emission control unit supplying to the light-emitting element, from immediately after the switching, a driving current amount corresponding to a first digital value acquired by quantizing the first target current value, and causing the light-emitting element to emit light; a time amount estimation unit estimating a time amount through which a driving current amount required for keeping the light-emitting element emitting the first light amount increases from the driving current amount required for causing the light-emitting element to emit the first light amount immediately after the switching to a driving current amount corresponding to a second digital value greater than the first digital value by one step; and a second light emission control unit supplying to the light-emitting element, when the time amount elapses after the switching, the driving current amount corresponding to the second digital value, and causing the light-emitting element to emit light.

Yet yet another aspect of the present invention is an image forming device including an optical writing device performing optical writing by using a light-emitting element and capable of performing switching of a light amount of the light-emitting element between a plurality of preset light amounts, light emission efficiency of the light-emitting element decreasing as light-emission time increases, a driving current amount required for keeping the light-emitting element emitting one light amount increasing as light-emission time increases, the optical writing device including: a target current value estimation unit estimating, based on light-emission time, a target current value corresponding to a driving current amount required for causing the light-emitting element to emit, immediately before the switching, a light amount that is utilized before the switching among the preset light amounts.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An optical writing device performing optical writing by using a light-emitting element and capable of performing switching of a light amount of the light-emitting element between a plurality of preset light amounts, light emission efficiency of the light-emitting element decreasing as light-emission time increases, a driving current amount required for keeping the light-emitting element emitting one light amount increasing as light-emission time increases, the optical writing device comprising:

a first target current value estimation unit estimating a first target current value corresponding to a driving current amount required for causing the light-emitting element to emit a first light amount immediately after the switching, the first light amount being one of the preset light amounts that is utilized after the switching;

a first light emission control unit supplying to the light-emitting element, from immediately after the switching, a driving current amount corresponding to a first digital value acquired by quantizing the first target current value, and causing the light-emitting element to emit light;

a time amount estimation unit estimating a time amount through which a driving current amount required for keeping the light-emitting element emitting the first light amount increases from the driving current amount required for causing the light-emitting element to emit the first light amount immediately after the switching to a driving current amount corresponding to a second digital value greater than the first digital value by one step;

a second light emission control unit supplying to the light-emitting element, when the time amount elapses after the switching, the driving current amount corresponding to the second digital value, and causing the light-emitting element to emit light; and a light-emission time measuring unit measuring a time amount for which the light-emitting element is caused to emit light by being supplied with a driving current amount corresponding to one digital value, the light-emission time measuring unit measuring the time amount for which the light-emitting element is caused to emit light by being supplied with a driving current amount corresponding to one digital value by counting the number of times the light-emitting element is caused to emit light by being supplied with a driving current amount corresponding to one digital value.

2. The optical writing device of claim 1 further comprising a second target current value estimation unit estimating, based on light-emission time, a second target current value corresponding to a driving current amount required for causing the light-emitting element to emit a second light amount immediately before the switching, the second light amount being one of the preset light amounts that is utilized before the switching, wherein the first target current value estimation unit estimates the first target current value based on (i) the second target current value and (ii) a conversion factor in accordance with the first and second light amounts.

3. The optical writing device of claim 2 further comprising:

a correction factor storing unit storing a correction factor that is in accordance with the decrease in light emission efficiency, wherein the second target current value estimation unit estimates the second target current value by adding, to a product yielded by multiplying the time amount measured by the light-emission time measuring unit and the correction factor, the driving current amount corresponding to the one digital value.

4. The optical writing device of claim 2 further comprising a conversion factor storage unit storing the conversion factor in accordance with the first and second light amounts, wherein the first target current value estimation unit estimates the first target current value based on (i) the second target current value and (ii) the conversion factor in accordance with the first and second light amounts, which is stored in the conversion factor storage unit.

5. The optical writing device of claim 1, wherein the time amount estimation unit estimates the time amount by estimating the number of times the light-emitting element emits light before the driving current amount required for keeping the light-emitting element emitting the first light amount increases from the driving current amount required for causing the light-emitting element to emit the first light amount immediately after the switching to the driving current amount corresponding to the second digital value.

6. The optical writing device of claim 1, wherein the light-emitting element is an organic light-emitting diode.

7. An optical writing device performing optical writing by using a light-emitting element and capable of performing switching of a light amount of the light-emitting element between a plurality of preset light amounts, light emission efficiency of the light-emitting element decreasing as light-emission time increases, a driving current amount required for keeping the light-emitting element emitting one light amount increasing as light-emission time increases, the optical writing device comprising:

a target current value estimation unit estimating, based on light-emission time, a target current value corresponding to a driving current amount required for causing the light-emitting element to emit, immediately before the switching, a light amount that is utilized before the switching among the preset light amounts; and a light-emission time measuring unit measuring a time amount for which the light-emitting element is caused to emit light by being supplied with a driving current amount corresponding to one digital value, the light-emission time measuring unit measuring the time amount for which the light-emitting element is caused to emit light by being supplied with a driving current amount corresponding to one digital value by counting the number of times the light-emitting element is caused to emit light by being supplied with a driving current amount corresponding to one digital value.

8. The optical writing device of claim 7 further comprising:

a correction factor storing unit storing a correction factor that is in accordance with the decrease in light emission efficiency, wherein the target current value estimation unit estimates the target current value by adding, to a product yielded by multiplying the time amount measured by the light-emission time measuring unit and the correction factor, the driving current amount corresponding to the one digital value.

9. The optical writing device of claim 1 further comprising:

a second target current value estimation unit estimating, based on light-emission time, a second target current value corresponding to a driving current amount required for causing the light-emitting element to emit a second light amount immediately before the switching, the second light amount being one of the preset light amounts that is utilized before the switching; and a function storage unit storing a function allowing estimating the first target current value based on the second target current value, wherein the first target current value estimation unit estimates the first target current value based on the second target current value by using the function stored in the function storage unit.

10. The optical writing device of claim 1 further comprising an increase amount storage unit storing an increase amount for compensating for a decrease in light emission efficiency of the light-emitting element occurring each time the light-emitting element is caused to emit light, wherein the time amount estimation unit estimates the time amount by calculating a difference between the driving current amount required for causing the light-emitting element to emit the first light amount immediately after the switching and the driving current amount corresponding to the second digital value, and dividing the difference by the increase amount.

11. The optical writing device of claim 10 further comprising a temperature acquisition unit acquiring a value indicating a temperature of the light-emitting element, wherein the increase amount storage unit stores the increase amount in plurality, one for each of a plurality of values each corresponding to a different temperature of the light-emitting element, and the time amount estimation unit estimates the time amount by dividing the difference by using one of the plurality of increase amounts that corresponds to the value acquired by the temperature acquisition unit.

12. The optical writing device of claim 7, wherein the light-emitting element is an organic light-emitting diode.

13. An image forming device comprising:

an optical writing device performing optical writing by using a light-emitting element and capable of performing switching of a light amount of the light-emitting element between a plurality of preset light amounts, light emission efficiency of the light-emitting element decreasing as light-emission time increases, a driving current amount required for keeping the light-emitting element emitting one light amount increasing as light-emission time increases, the optical writing device comprising:

a first target current value estimation unit estimating a first target current value corresponding to a driving current amount required for causing the light-emitting element to emit a first light amount immediately after the switching, the first light amount being one of the preset light amounts that is utilized after the switching;

a first light emission control unit supplying to the light-emitting element, from immediately after the switching, a driving current amount corresponding to a first digital value acquired by quantizing the first target current value, and causing the light-emitting element to emit light;

a time amount estimation unit estimating a time amount through which a driving current amount required for keeping the light-emitting element emitting the first light amount increases from the driving current amount required for causing the light-emitting element to emit the first light amount immediately after the switching to a driving current amount corresponding to a second digital value greater than the first digital value by one step;

a second light emission control unit supplying to the light-emitting element, when the time amount elapses after the switching, the driving current amount corresponding to the second digital value, and causing the light-emitting element to emit light; and a light-emission time measuring unit measuring a time amount for which the light-emitting element is caused to emit light by being supplied with a driving current amount corresponding to one digital value, the light-emission time measuring unit measuring the time amount for which the light-emitting element is caused to emit light by being supplied with a driving current amount corresponding to one digital value by counting the number of times the light-emitting element is caused to emit light by being supplied with a driving current amount corresponding to one digital value.

14. An image forming device comprising an optical writing device performing optical writing by using a light-emitting element and capable of performing switching of a light amount of the light-emitting element between a plurality of preset light amounts, light emission efficiency of the light-emitting element decreasing as light-emission time increases, a driving current amount required for keeping the light-emitting element emitting one light amount increasing as light-emission time increases, the optical writing device comprising:

a target current value estimation unit estimating, based on light-emission time, a target current value corresponding to a driving current amount required for causing the light-emitting element to emit, immediately before the switching, a light amount that is utilized before the switching among the preset light amounts; and a light-emission time measuring unit measuring a time amount for which the light-emitting element is caused to emit light by being supplied with a driving current amount corresponding to one digital value, the light-emission time measuring unit measuring the time amount for which the light-emitting element is caused to emit light by being supplied with a driving current amount corresponding to one digital value by counting the number of times the light-emitting element is caused to emit light by being supplied with a driving current amount corresponding to one digital value.

* * * * *